US005315804A

United States Patent [19]

Attalla

[11] Patent Number: 5,315,804

[45] Date of Patent: May 31, 1994

[54] METAL FRAMING MEMBER

[75] Inventor: Anthony P. Attalla, Amherst, N.H.

[73] Assignee: Hexa-Port International Ltd., Bedford, N.H.

[21] Appl. No.: 947,495

[22] Filed: Sep. 18, 1992

[51] Int. Cl.[5] ..... E04C 3/16

[52] U.S. Cl. ..... 52/731.1; 52/362

[58] Field of Search ..... 52/731.1, 357-364, 52/362, 52/720, 348, 349

[56] References Cited

U.S. PATENT DOCUMENTS

| | | | |
|---|---|---|---|
| 2,371,921 | 3/1945 | Tucker | 52/290 |
| 2,706,315 | 4/1955 | Price | 52/364 |
| 3,129,792 | 4/1964 | Gwynne | 52/264 |
| 3,243,930 | 4/1966 | Slowinski | 52/364 |
| 4,112,636 | 9/1978 | Hays | 52/355 |
| 4,513,551 | 4/1985 | Gauffin et al. | 52/364 |

*Primary Examiner*—James L. Ridgill, Jr.
*Attorney, Agent, or Firm*—William B. Ritchie

[57] ABSTRACT

An improved metal framing member that utilizes stiffening sections to enable lighter gauge of metal to be used. The framing member also features embossed surfaces that facilitate fastening using standard self-tapping fasteners. Safety edges are provided to eliminate the sharp edge problem of handling metal framing members. The framing member is designed to be fabricated using rollforming methods in all standard sizes of studs, floor joists, rafters, and trusses.

6 Claims, 3 Drawing Sheets

METAL FRAMING MEMBER

BACKGROUND OF THE INVENTION

1. Field of the Invention

The invention relates to dwelling framing members fabricated from metal.

2. Description of the Related Art

Typical house and apartment construction has utilized wood for the structural members such as wall studs, floor joists, roof rafters and the like. In those areas where wood was scarce, concrete block construction, brick and, in limited situations, metal structural members were substituted. However, wood remains the material of choice despite its inherent drawbacks such as flammability and lack of insect resistance. While methods exist for making wood insect resistant and reducing its flammability, these methods add significantly to the cost of the timber, thereby removing the principle advantage of the material . . . low cost.

As more and more forests are being depleted at a faster and faster rate, and as more environmental concerns are being expressed concerning the eradication of forest reserves, particularly rain forests, wood is rapidly losing its advantage as the preferable material for home construction. Moreover, the quality of wood building materials has diminished inversely proportionately to the increase in price and scarcity. The consequences of using substandard lumber with an excess of knots and low structural strength is particularly evident when such buildings are subjected to the force of high winds as is found with typical hurricanes or other severe storms. While metal construction beams and studs are an ideal framing material, being insect proof, fire-proof, with high uniformity and strength, their use has been limited due to high cost, erection problems and handling difficulties. Current metal studs and "hat sections" (members between studs used as nailers for sheet rock and other wall systems) are manufactured with sharp edges that can easily cut the hands of a worker. Further, although hat sections provide an embossed fastening surface that prevents self-tapping fasteners from sliding by providing numerous indentations to serve as a pilot, such surfaces have not been incorporated into framing members such as studs and joists. A metal structural member, suitable for wall studs, floor joists, roof rafters, and trusses, that is low cost, easy to fasten, and can be handled safely is not found in the prior art.

SUMMARY OF THE INVENTION

It is an object of the invention to provide an improved metal framing member that can be fabricated with a lighter gauge steel that has the same strength as a framing member fabricated with the next heavier gauge steel.

It is another object of the invention to provide an improved metal framing member that has a safety edge so that a worker's hands will not be cut when handling the framing member.

It is still another object of the invention to provide an improved framing member that is suitable to be used for all customary sizes, ranging from 2×4's to 2×12's.

It is still another object of the invention to provide an improved framing member that is impervious to insect damage and is inflammable.

It is another object of the invention to provide an improved framing member that provides a plurality of stiffening sections.

It is a further objection of the invention to provide an improved framing member that has a plurality of embossed sections that facilitate fastening self-tapping fasteners.

It is a final object of the invention to provide an improved framing member that can be rolledformed, thereby enabling low cost.

The invention is a metal framing member for use with self-tapping fasteners. A rectangular bottom section having an outside surface and having left and right substantially parallel radiused edges along the length of said section is provided. Left and right rectangular side sections, substantially perpendicular to said bottom section, and having an outside surface and having radiused edges along their respective top and bottom lengths are provided. The bottom of the left side section is attached to the left edge of said bottom section and the bottom of the right side section is attached to the right edge of said bottom section. Left and right rectangular return sections, substantially perpendicular to said side sections, are provided. Each said return section has a radiused edge along one length and a safety edge along the other length. The radiused edge of the left return section is attached to the top edge of the left side section. The right return section is attached to the top edge of the right side section. Left and right embossed sections are respectively disposed on the outside surface of said left and right side sections. The embossed sections cover a substantial portion of said sections. The embossed sections comprise a plurality of indentations with the depth and density of said indentations adapted to prevent the tip of the self-tapping fastener from slipping during insertion. A plurality of stiffener sections, longitudinally placed on said bottom section, substantially parallel to the edges of said bottom section are provided.

DETAILED DESCRIPTION OF THE INVENTION

Figure 1:
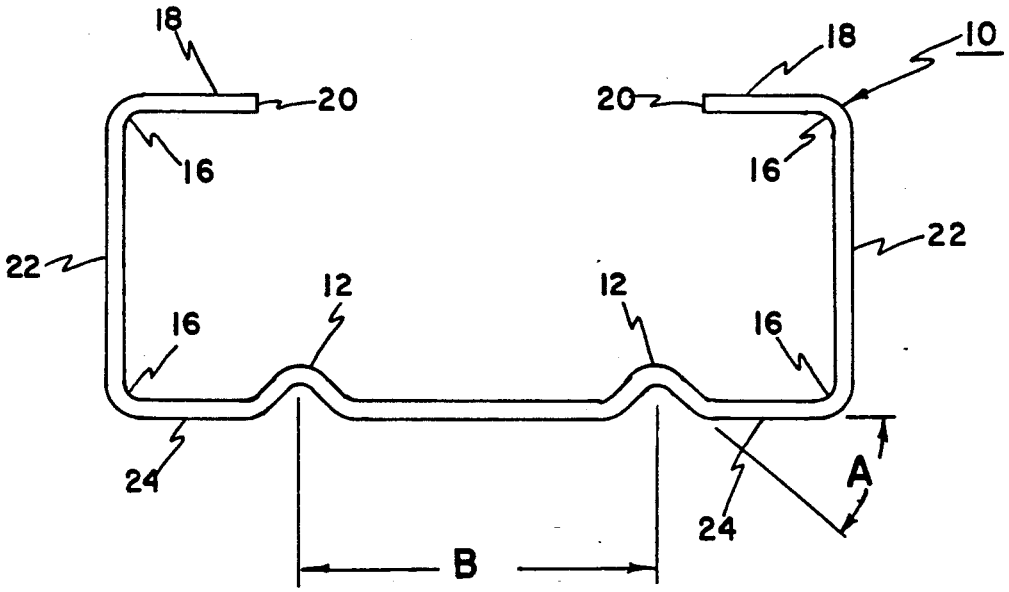
FIG. 1 is cross-sectional view of the framing member in accordance with the invention.

FIG. 1 is cross-sectional view of invention 10. Side sections 22 are preferably 1.5 inches. However, this dimension is not critical and can be adjusted up or down as required by changing building codes. Bottom surface 24 is preferably 2.823 inches wide when invention 10 is used in the standard 2×4 configuration. If a standard 2×12, for example, is required for a floor joist, then side 22 would remain 1.5 inches, while bottom surface 24 would change to 11.823 inches. Assuming that two stiffening sections were used, each would again be approximately 1 inch from section 22 on bottom 24.

Invention 10 in the 2×4 configuration is preferably constructed from a strip of galvanized mild steel 8.08 inches wide and as long as required for the desired stud length. Preferably invention 10 will be fabricated using standard gauges of galvanized mild steel by rollforming techniques and machinery such as the type manufactured by The Bradbury Company, Inc. However, invention 10 could also be manufactured using other sheet metal fabrication methods such as stamping and brakes.

Each stiffener 12 is located approximately 1 inch from side 22. While two stiffeners 12 run longitudinally the length of the stud, more stiffeners could be used depending on the strength requirements. In the present case, it is anticipated that the use of two stiffeners 12 will enable the use of the next size smaller gauge to achieve the same strength. Changing from an 18 gauge metal to a 16 gauge metal enables a 30% savings without compromising structural integrity.

Each stiffener 12 is preferably about ⅛ inch deep. Angle A is approximately 45 degrees. Each inside radius 16 of invention 10 is preferably 0.125 inches with return sections 18 about ¾ inches wide. Safety edge 20 is provided at each end of the return section to prevent workers from cutting themselves while handing the stud. Safety edge 20 would be preferably provided during the rollforming process by rolling the edge to remove any sharpness. The safety edge could also be done later or earlier in the manufacturing process by other techniques such as grinding.

Figure 2:
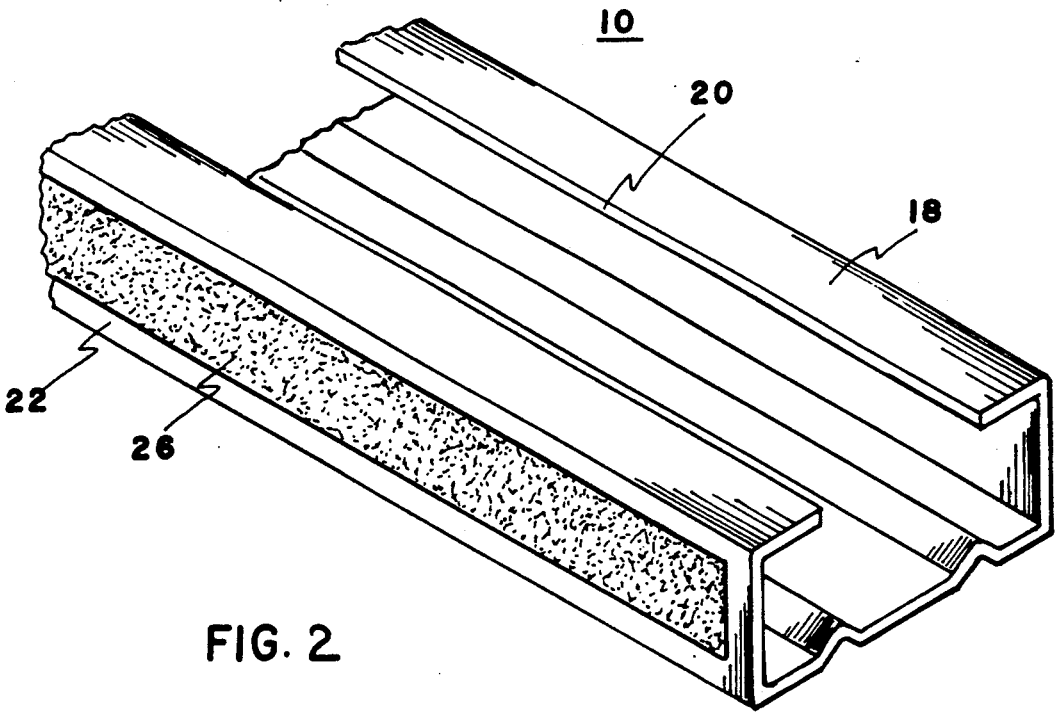
FIG. 2 is a isometric view of the framing member in accordance with the invention.
Figure 3:
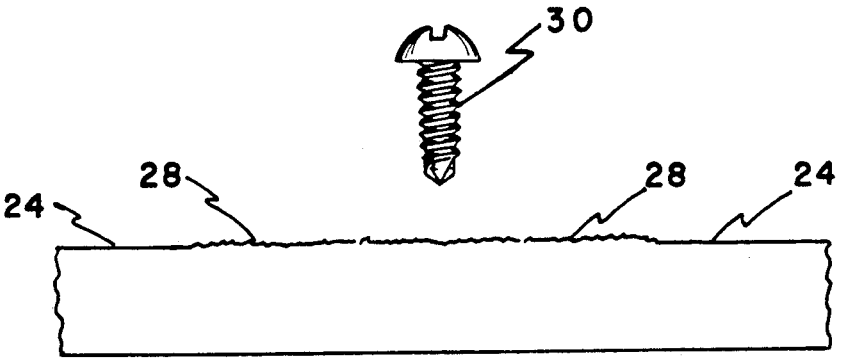
FIG. 3 is a cross-sectional detail showing the embossing surface.

FIG. 2 is a isometric view of the framing member showing fastening embossed section 26. As shown, section 26 runs the entire length of the stud on each side section 22. In the cross-section detail of embossed section 26, as shown in FIG. 3, a plurality of indentations 28 provide a "pilot hole" for self-tapping fastener 30 so that fastener 30 will not slip on section 22. If fastener 30 slips on section 22, it is difficult to screw fastener 30 into the surface and, if the slippage results in fastener 30 being screwed into section 22 at an acute angle, it may significantly lessen the holding power of fastener 30. Indentations 28 are preferably random closely spaced dimpling over the embossed section 26.

Figure 4:
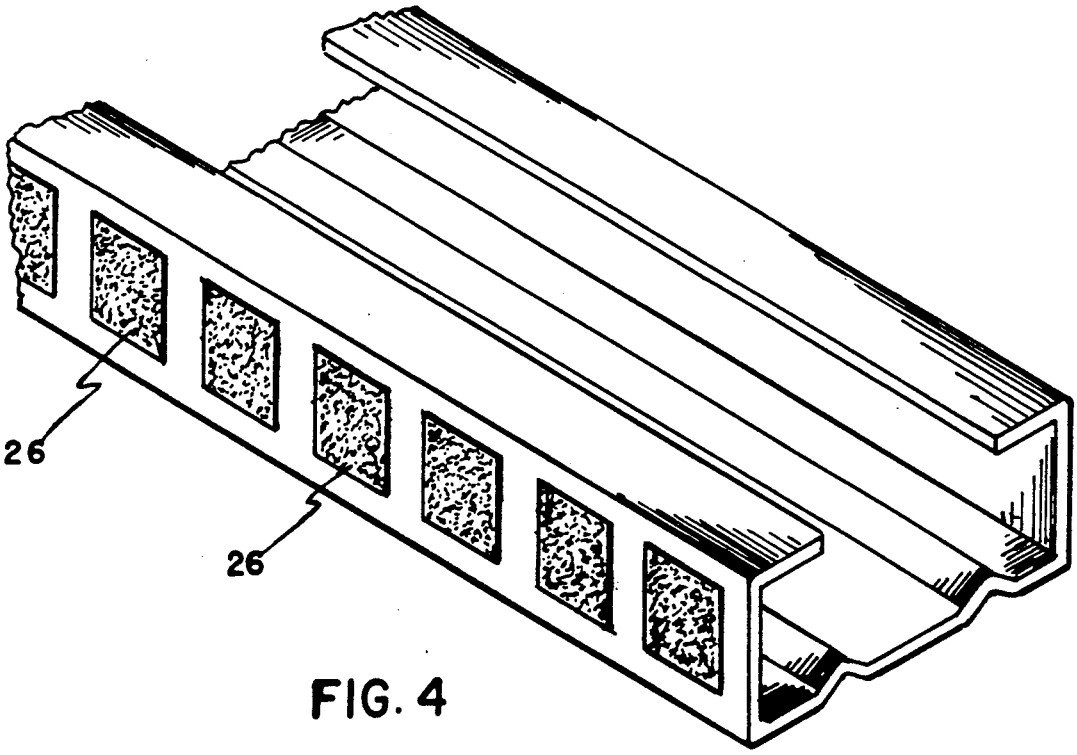
FIG. 4 is an isometric view of the framing member showing an alternative embossing pattern.
Figure 5:
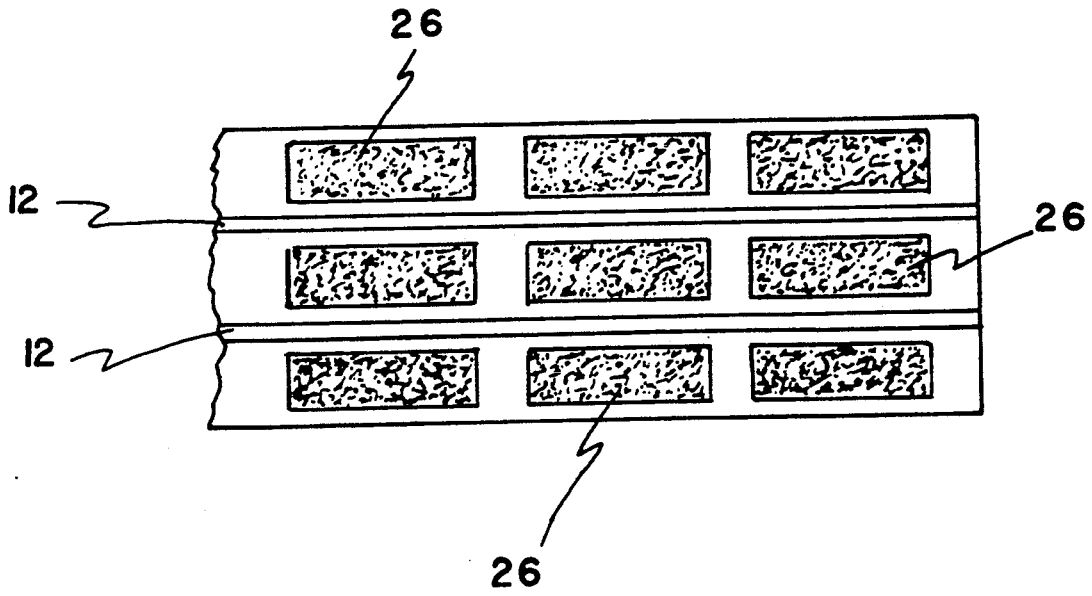
FIG. 5 is a bottom view of the framing member showing a second alternative embossing pattern.

FIG. 4 shows an alternative embodiment for the fastening surface by providing a discontinuous plurality of embossed sections 26 along sections 22. FIG. 5 shows a second alternative embodiment for the fastening surface by providing embossed sections 26 along bottom surface 24, either continuous or in a discontinuous fashion as shown. Embossed sections 26 could be used only on bottom 24 for structural members that would not require fastening along side section 22 or both on bottom surface 24 and side sections 22 as fastening requirements dictated.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A metal framing member for use with self-tapping fasteners comprising:

a rectangular bottom section having an outside surface and having left and right substantially parallel radiused edges along the length of said section;

left and right rectangular side sections, each having a thickness and substantially perpendicular to said bottom section, and having an outside surface and having radiused edges along their respective top and bottom lengths, with the bottom of the left side section attached to the left edge of said bottom section and with the bottom of the right side section attached to the right edge of said bottom section;

left and right rectangular return sections, substantially perpendicular to said side sections, each said return section having a radiused edge along one length and a safety edge along the other length sufficiently rounded to remove any sharpness capable of cutting a user's hand, with the radiused edge of the left return section attached to the top edge of the left side section and with right return section attached to the top edge of the right side section;

left and right embossed sections respectively disposed on the outside surface of said left and right side sections, said embossed sections covering a substantial portion of said sections, said embossed sections comprising a plurality of random spaced indentations having random depths substantially less than the thickness of said left and right side sections, with the depth and density of said indentations adapted to prevent the tips of the self-tapping fasteners from slipping during insertion; and a plurality of stiffener sections, longitudinally placed on said bottom section, substantially parallel to the edges of said bottom section.

2. The metal framing member of claim 1 further comprising a plurality of embossed sections disposed on the outside surfaces of said left and right side sections, said embossed sections covering a substantial portion of the outside surface of said side section surfaces.

3. The metal framing of claim 2 wherein said sections are integral with one another, fabricated from a single sheet of galvanized mild steel.

4. The metal framing member of claim 1 further comprising an embossed section disposed on the outside surface of said bottom section.

5. The metal framing member of claim 4 further comprising a plurality of embossed sections disposed on the outside surfaces of said bottom section, said embossed sections covering a substantial portion of the outside surface of said bottom section.

6. The metal framing member of claim 5 wherein said sections are integral with one another, fabricated from a single sheet of galvanized mild steel.

* * * * *